United States Patent [19]

Woods et al.

[11] 3,987,613

[45] Oct. 26, 1976

[54] PROCESS FOR PREPARING TEXTILES WITHOUT STATIC CHARGE ACCUMULATION AND RESULTING PRODUCT

[75] Inventors: Herbert J. Woods; Jack Leach, both of Greensboro, N.C.

[73] Assignee: Burlington Industries, Inc., Greensboro, N.C.

[22] Filed: July 29, 1965

[21] Appl. No.: 475,866

[52] U.S. Cl. ..... 57/140 BY; 57/139; 57/156; 57/157 R; 57/157 AS; 428/359

[51] Int. Cl.[2] ..... D02G 3/12; D02G 3/04

[58] Field of Search ..... 57/139, 140 R, 140 BY, 57/50, 156, 157 R, 160, 144, 157 AS; 28/72 R, 74, 75; 139/425

[56] References Cited

UNITED STATES PATENTS

| | | | |
|---|---|---|---|
| 1,012,031 | 12/1911 | Underwood | 139/425 |
| 1,096,077 | 5/1914 | Underwood | 28/74 |
| 1,811,573 | 6/1931 | Bacheldor et al. | 139/425 |
| 1,898,025 | 2/1933 | Wild | 139/425 |
| 2,302,003 | 11/1942 | Cadwell et al. | 57/157 AS |
| 2,508,852 | 5/1950 | Blumfield | 57/140 X |
| 2,532,395 | 12/1950 | Dreyfus | 57/140 |
| 2,836,529 | 5/1958 | Morris | 139/425 X |
| 2,930,105 | 3/1960 | Budd et al. | 57/140 C |
| 2,963,850 | 12/1960 | Rosenblatt | 57/139 |
| 3,099,066 | 7/1963 | Scharf | 57/140 C |
| 3,126,924 | 3/1964 | Kirkpatrick | 57/139 X |
| 3,277,564 | 10/1966 | Webber et al. | 57/139 UX |
| 3,288,175 | 11/1966 | Valko | 139/425 |

FOREIGN PATENTS OR APPLICATIONS

| | | | |
|---|---|---|---|
| 842,050 | 2/1939 | France | 139/425 |
| 372,274 | 1932 | United Kingdom | 139/425 |

OTHER PUBLICATIONS

Winkler; "Production and Processing of Metal Fibers"; May, 1958; Melliand; vol. 39; pp. 499–501.

*Primary Examiner*—John Petrakes
*Attorney, Agent, or Firm*—Cushman, Darby & Cushman

[57] ABSTRACT

A process is described for avoiding static charge buildup in handling textile fibers which normally develop such buildup. The process involves blending a minor amount of conductive metallic fiber, e.g. copper fiber, with the textile fiber prior to yarn formation. Spun yarns and fabrics made from these blends are also disclosed.

20 Claims, No Drawings

PROCESS FOR PREPARING TEXTILES WITHOUT STATIC CHARGE ACCUMULATION AND RESULTING PRODUCT

This invention relates to textiles, e.g. yarns and fabrics, which resist the accumulation of electrostatic charges.

The textile industry has been plagued by the problem of static electricity charges building up on textile fibers and fabrics. The problems of static distribution can occur during, for example, warping, slashing, winding, spinning, carding, gill reducing, drawing, twisting, weaving, knitting, tentering, cloth examination, tailoring or sewing, and various conditions of final usage by the ultimate consumer. More specific examples of the problems existing for the consumer are the shocks experienced by persons caused by electrostatic charges in such items as carpets, automobile upholstery, and the like; the clinging of garments to each other or the wearer in cool, dry weather; the build-up of electrostatic charges on, for example, synthetic fabrics, to cause dust, dirt and foreign particles to be attracted to the fabric surface; and fire hazards caused by sparks produced by electrostatic charge buildup on industrial fabrics.

In the textile plant, the effect of powerful electrostatic charges is usually counteracted by maintaining an atmosphere of high humidity or by the ionization of air in the immediate vicinity of the textile, for example, while rolling or unrolling fabric. A chemical solution to the problem is to apply an anti-static finish.

Discretion must be used in applying chemical anti-static finishes since certain types may be corrosive, may dust when dry, or have a very bad effect on the handling of yarn and fabrics. Other types, designed for a particular textile processing operation, may be detrimental in other operations by modifying the lubricity of the materials to cause high back-winding tensions or other problems. Furthermore, those anti-static finishes which are used in special processing operations must be capable of being removed whenever their presence may interfere with other operations, as, for example, dyeing. Permanence in an anti-static finish is normally desirable, but the industry has not set definite standards for products as well as for performance requirements, since so many variables are involved.

It is an object of the invention to produce a textile material, e.g. yarn or fabric, with permanent anti-static characteristics. Other objects and advantages over prior effects will be apparent from the following description of the invention.

Briefly, the present invention relies upon introducing a minor amount, for example, 1 to 6% by weight, of a spinnable conductive metallic fiber into synthetic or natural fibers which would normally tend to build up an undesirable static charge. According to the invention, the metallic fibers and the conventional fibers are blended together and spun into yarn. The latter may then be used to prepare woven, knitted or nonwoven fabric as may be desired. Stainless steel fibers and copper fibers of 1 inch to 3½ inches length or 0.0005 to 0.0015 inch diameter have proven particularly desirable for the purposes of this invention.

Most of the synthetic fibers, such as acetate, nylon, acrylic, and polyester fibers, have serious static problems. It is within the scope of this invention to use the above or any other synthetic textile fibers, or any of the natural fibers, such as wool, cotton, silk, or linen, or blends of synthetic and/or natural fibers, in combination with a minor amount of one or more spinnable conductive metallic fibers.

Apparel fabrics, carpet fabrics, and the like which have had undesirable characteristics of electrostatic charge build-up generally have exhibited a resistance higher than $10^{12}$ megohms. Untreated nylon with high static properties has exhibited a resistance as high as $10^{15}$ megohms. Fabrics treated with anti-static materials, e.g. liquid sprays, finishing treatments, etc., have a resistance generally in the order of $10^{10}$ megohms. In contrast, fabrics produced by the process of the present invention and containing, for example, as little as 1% of spinnable stainless steel fibers, have a resistance of 100 megohms or less. This resistance drops rapidly as the percentage of stainless steel fibers or other conductive metallic fiber is increased.

While it has been found desirable to use 1 to 6% of the conductive metallic fiber in textile yarns according to the invention, greater or lesser amounts of the metallic fiber may be used. However, too high a percentage of metallic fiber will produce a fabric with poor hand and drape, whereas too little of the metallic fiber will not produce an effective reduction of the static properties. In general, 0.25% to 15% by weight of the conductive metallic fiber, on the total yarn weight, may be included for present purposes, it being understood that the amount selected for any particular situation will vary depending on other conditions, e.g. the other fiber or fibers involved, and the processing conditions which may be contemplated.

As noted earlier, copper fibers and stainless steel fibers are the preferred spinnable conductive metallic fibers of this invention. However, any spinnable conductive metallic fibers may be used. In this connection, it will be appreciated that in addition to, or in lieu of, conductive metallic staple, continuous filaments may be used. In the circumstances, the term "fibers" is used herein to define the conductive metallic component in staple or continuous form.

The invention is illustrated, but not limited, by the following examples

EXAMPLE I

A blend of 3% of stainless steel fibers of 0.001 inch diameter and 1½ inch length and 97% of Orlon acrylic fibers (of 1½ inch average length of 2.4 denier) were spun in conventional fashion to give a 531 denier yarn having 10 turns per inch therein. During carding of the blend, electrostatic voltmeters at the card web indicated a near zero reading with the fiber blend. In contrast, acrylic fibers without the addition of the conductive metal fibers often produce a reading as high as 500 – 600 electron volts in the normal operation of a card. From blending through carding and other preparation steps to yarn formation, there was no significant static charge accumulation. Fabric produced from the yarn had excellent hand and drape as well as anti-static properties.

EXAMPLE II

Very finely drawn copper wire fibers (1½ inch length and 0.001 inch diameter) and nylon fibers (1½ inch long and 3 denier) were blended in a ratio of 4% copper fibers to 96% nylon fibers. The fiber blend was spun into yarn (531 denier) and then used as the filling and warp to make a woven fabric comprising 37 ends and 28 picks of a typical 3⅓ yards per pound Osnaburg type fabric.

This fabric had acceptable hand and drape and there was no static charge problem in processing the blend into yarn or fabric. An identical fabric produced from only the nylon fibers had a resistance of $10^{14}$ megohms whereas the resistance of the fabric produced with the fiber blend of this example was less than 100 megohms.

EXAMPLE III

Stainless steel fibers similar to those of Example I were blended with wool fibers, and then the blend was carded, conventionally pocessed into spun yarn and then woven into fabric as both filling and wrap. 6% of the fiber blend was metallic fiber, the balance wool. The fabric had no significant static accumulation. Its resistance measured less than 100 megohms, well below the point where static charge presents a problem.

Essentially similar results were obtainable using continuous filaments of stainless steel or copper (monofilament or multifilament) in the amounts shown in the foregoing examples in lieu of the staple metal fibers.

Various modifications may be made in the invention described herein. Hence, the scope of the invention is defined in the following claims.

We claim:

1. An antistatic textile comprising a substantially uniformly distributed blend of electrically conductive yarn-forming metallic fiber or fibers having a diameter of less than approximately 0.001 inches and a length of under approximately 2 inches, and electrically nonconductive fibers, said conductive to nonconductive fibers being present in a weight ratio of about 1% or below.

2. An antistatic textile comprising a blend of electrically conductive yarn-forming metallic fiber or fibers having a diameter of less than approximately 0.001 inch, and electrically non-conductive fiber or fibers, said conductive to non-conductive fiber or fibers being present in a weight ratio of about 1% or below.

3. An antistatic textile comprising a blend of electrically conductive yarn-forming metallic fiber or fibers having a diameter of less than approximately 0.001 inch, and electrically non-conductive fiber or fibers, said conductive to non-conductive fiber or fibers being present in a weight ratio of about 1% to about6%.

4. In a process for making an antistatic yarn from textile fibers which normally tend to accumulate an undesirable static charge build-up, the improvement comprising blending from 0.25% to about 15% by weight of a conductive metallic fiber or fibers with said textile fibers, wherein said conductive metallic fiber or fibers have a diameter of less than approximately 0.001 inches.

5. A spun antistatic yarn comprising an intimate blend of from about 0.25% to about 15% by weight of a conductive metallic fiber or fibers and about 99.75% to about 85% by weight of textile fiber or fibers which normally tend to accumulate an undesirable static charge, wherein said metallic fiber or fibers have a diameter of less than approximately 0.001 inches, the amount of metallic fiber or fibers being sufficient to avoid said accumulation of static charge.

6. A fabric comprising a yarn made up of a combination of textile fibers which normally tend to accumulate an undesirable static charge build-up and a minor amount of conductive, metallic fiber present in an amount sufficient to prevent said static charge build-up wherein said metallic fiber having a diameter of less than approximately 0.001 inches and wherein said minor amount of said metallic fiber is about 1% or less by weight of the metallic fiber to the total textile fiber weight.

7. A fabric comprising yarn made up of a combination of textile fibers which normally tend to accumulate an undesirable static charge build-up and a minor amount of conductive, metallic fiber present in an amount sufficient to prevent said static charge build-up wherein said metallic fiber having a diameter of less than approximately 0.001 inches and wherein said minor amount of said metallic fiber is about from 1% to about 6% by weight of the metallic fiber to the total textile fiber weight.

8. The fabric of claim 7 wherein said metallic fiber is in staple form.

9. The fabric of claim 7 wherein said metallic fiber is in continuous filament form.

10. The process of claim 4 including the steps of drafting, spinning and fabric formation after blending the metallic fiber with said fibers.

11. The process of claim 4 wherein said metallic fiber is selected from the group consisting of copper and steel fibers.

12. The process of claim 11 wherein said metallic fiber is in the form of staple.

13. The process of claim 11 wherein said metallic fiber is in continuous filament form.

14. The fabric of claim 6 wherein said metallic fiber is in staple form.

15. The fabric of claim 6 wherein said metallic fiber is in continuous filament form.

16. The yarn of claim 5 wherein said textile fibers are natural textile fibers.

17. The yarn of claim 5 wherein said textile fibers are synthetic textile fibers.

18. The yarn of claim 5 wherein said textile fibers are blends of natural and synthetic fibers.

19. A yarn according to claim 5 wherein said metallic fiber is in staple form.

20. A yarn according to claim 5 wherein said metallic fiber is in continuous filament form.

* * * * *